US008984992B2

(12) United States Patent
Newkirk et al.

(10) Patent No.: US 8,984,992 B2
(45) Date of Patent: Mar. 24, 2015

(54) SOCKET WITH NUT OR BOLT HOLDING STRUCTURE

(71) Applicant: ABB Technology Ltd., Zurich (CH)

(72) Inventors: Jeremy Newkirk, West Hartford, CT (US); William John Eakins, Bloomfield, CT (US); Thomas Fuhlbrigge, Ellington, CT (US); Harald Josef Staab, Bavaria (DE)

(73) Assignee: ABB Technology Ltd., Zürich (CH)

( * ) Notice: Subject to any disclaimer, the term of this patent is extended or adjusted under 35 U.S.C. 154(b) by 275 days.

(21) Appl. No.: 13/660,230

(22) Filed: Oct. 25, 2012

(65) Prior Publication Data

US 2014/0116203 A1 May 1, 2014

(51) Int. Cl.

| | |
|---|---|
| ***B25B 23/08*** | (2006.01) |
| ***B25B 13/06*** | (2006.01) |
| ***B25B 23/10*** | (2006.01) |

(52) U.S. Cl.

CPC ..... *B25B 13/06* (2013.01); *B25B 23/08* (2013.01); *B25B 23/108* (2013.01)

USPC ..... 81/125; 81/54

(58) Field of Classification Search

USPC ..... 81/121.1, 125, 124.3, 124.6, 177.85, 54

See application file for complete search history.

(56) References Cited

U.S. PATENT DOCUMENTS

| | | | | |
|---|---|---|---|---|
| 1,585,338 | A * | 5/1926 | Fisher et al. | 81/125 |
| 3,005,367 | A * | 10/1961 | Vose | 81/125 |
| 4,593,583 | A * | 6/1986 | Singleton | 81/124.3 |
| 5,309,798 | A * | 5/1994 | Markwart et al. | 81/177.85 |
| 6,382,053 | B1 * | 5/2002 | Macor | 81/121.1 |
| 6,925,914 | B2 | 8/2005 | Hsien | |
| 7,162,938 | B1 | 1/2007 | Peters | |
| 7,246,540 | B2 | 7/2007 | Rillera | |
| 7,752,946 | B2 * | 7/2010 | Wang | 81/125 |

OTHER PUBLICATIONS

Grip-Tite(TM) Super Socket Sets found at http://www.bt-andf.com/index.php, accessed on Sep. 28, 2012, copyright 2006.

* cited by examiner

*Primary Examiner* — Hadi Shakeri

(74) *Attorney, Agent, or Firm* — Manelli Selter PLLC; Edward J. Stemberger

(57) ABSTRACT

A socket is provided for removing or installing a fastener having a hexagonally shaped portion. The socket includes a body having a longitudinal axis and opposing first and second ends. First surfaces define a tool-receiving portion at the first end. The tool-receiving portion is constructed and arranged to receive a portion of a tool. Second surfaces define a socket portion at the second end. The socket portion is constructed and arranged to receive and engage the portion of the fastener therein. Holding structure is associated with the socket portion and is constructed and arranged to non-magnetically hold the portion of the fastener in the socket portion so as to not fall out of the socket portion, either due to friction or vacuum, without providing torque to the fastener when the socket is rotated during installation or removal of the fastener.

9 Claims, 5 Drawing Sheets

SOCKET WITH NUT OR BOLT HOLDING STRUCTURE

FIELD

The invention relates to holding a nut or a bolt after unscrewing or before screwing, preferably when this process is automated and, more particularly, to structure and methods for securely holding a nut or bolt within a socket by friction or by vacuum.

BACKGROUND

When using a socket wrench to install or remove a nut or bolt, there is a tendency for the nut or bolt to fall out of the socket when it is not engaged. When the nut or bolt is engaged, the retaining force on the nut or bolt is much greater than the holding force on the socket. Therefore, the wrenching tool, including the socket, can be retracted off of the nut or bolt.

Using a socket that holds the nut or bolt is useful in manual operation, but is particularly useful when the wrenching operation is automated, since there may not be an operator near the wrench to replace the nut or bolt if it falls from the socket.

Magnets have been used to hold a nut or bolt in a socket. However, there is a possibility that foreign, ferrous material may be attracted by the magnet and enter the socket, requiring an operator to remove the foreign material.

Thus, there is a need to provide a structure for holding a nut or bolt in a socket by friction or by a vacuum.

SUMMARY

An objective of the invention is to fulfill the need referred to above. In accordance with the principles of the present invention, this objective is obtained by providing a socket for removing or installing a fastener having a hexagonal shaped portion. The socket includes a body having a longitudinal axis and opposing first and second ends. First surfaces define a tool-receiving portion at the first end. The tool-receiving portion is constructed and arranged to receive a portion of a tool. Second surfaces define a socket portion at the second end. The socket portion is constructed and arranged to receive and engage the portion of the fastener therein. Holding structure is associated with the socket portion and is constructed and arranged to non-magnetically hold the portion of the fastener in the socket portion so as to not fall out of the socket portion, without providing torque to the fastener when the socket is rotated during installation or removal of the fastener.

In accordance with another aspect, a method of holding a fastener with respect to a socket provides a socket having surfaces defining a socket portion. The socket is placed over a portion of a fastener so that the portion of the fastener is received in the socket portion. Holding structure, associated with the socket portion, is utilized to non-magnetically hold the portion of the fastener in the socket portion so as to not fall out of the socket portion, without providing torque to the fastener when the socket is rotated during installation or removal of the fastener.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF EXEMPLARY EMBODIMENTS

Figure 1:
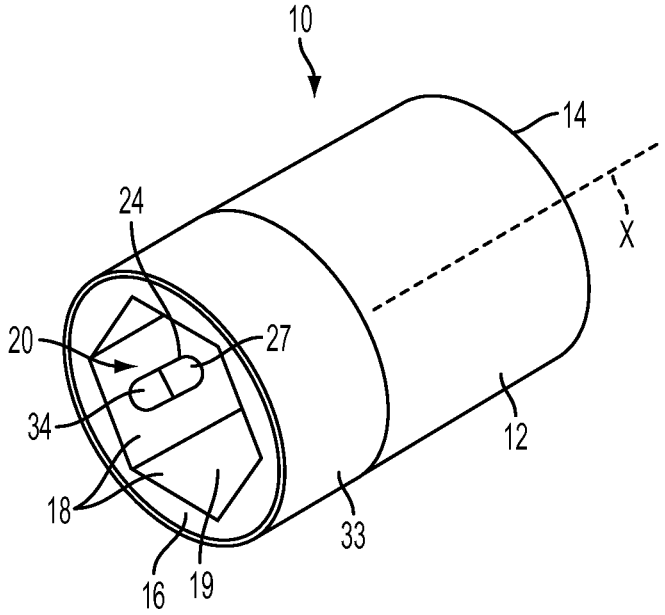
FIG. 1 is a perspective view of a socket having holding structure in accordance with an embodiment.

With reference to FIGS. 1-4, a socket for installing or removing fasteners is shown, generally indicated 10, in accordance with an embodiment of the invention. The socket 10 includes a generally cylindrical body 12 having a longitudinal axis X and opposing, first and second ends 14 and 16, respectively. The first end 14 includes surfaces 15 defining a preferably square shaped, tool-receiving portion 17 that is constructed and arranged to be removably received by a tool such as a socket wrench 40 (FIG. 3) therein. The second end 16 includes surfaces 18 defining a socket portion 19 in the conventional manner constructed and arranged to receive and engage a hexagonally-shaped portion of fastener therein. As used herein, "fasteners" includes heads of bolts, studs, nuts, or any other hexagonally-shaped structure. The socket portion 19 is preferably hexagonally shaped, but can be other shapes that can receive and engage a hexagonally-shaped portion of fastener therein.

Figure 2:
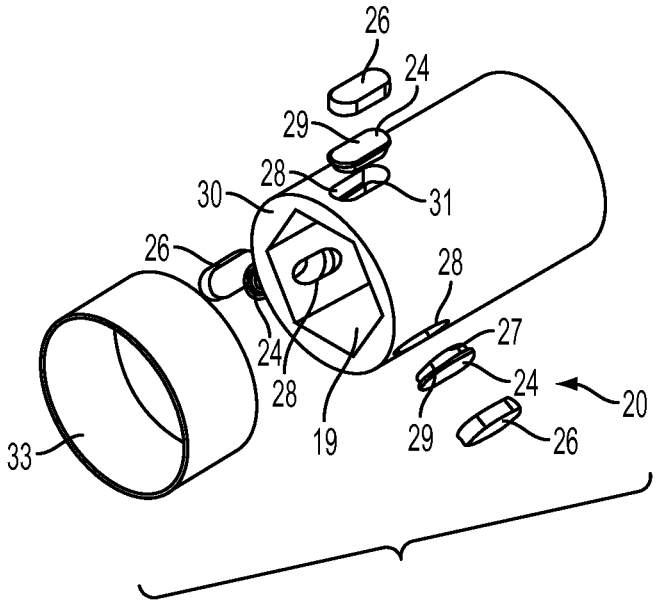
FIG. 2 is an exploded view of the socket with the holding structure of FIG. 1.
Figure 3:
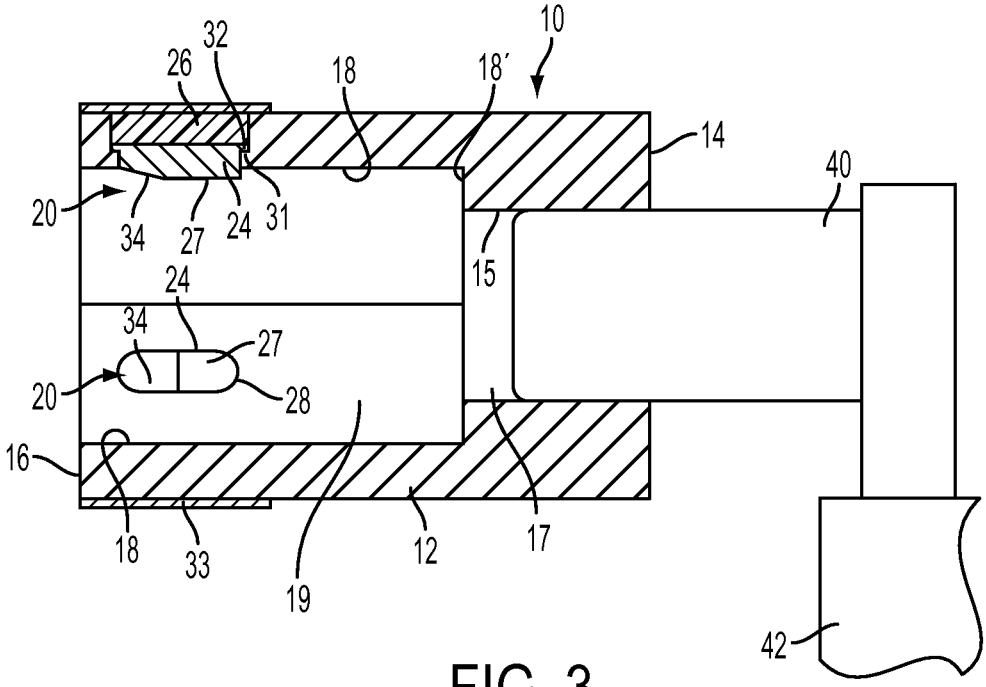
FIG. 3 is sectional view of the socket with the holding structure of FIG. 1.
Figure 4:
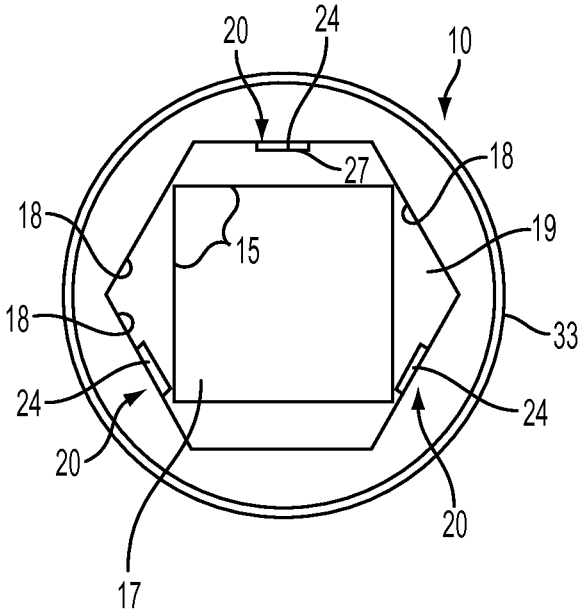
FIG. 4 is a front view of the socket with the holding structure of FIG. 1.

The socket 10 includes at least one holding structure, generally indicated at 20. Each holding structure 20 includes a rigid tooth 24, preferably of metal, and a spring member 26, engaged with a back end 29 of the tooth 24. Each tooth 24 and associated spring member 26 is received in an opening 28 through the wall 30 of the body 12. The openings 28 extend perpendicularly with respect to the longitudinal axis X and communicate with the socket portion 19 so that the tooth 24 extends into the socket portion 19. With reference to FIG. 3, a lip 31 is provided in each opening 28 and the tooth 24 includes a flange 32 that engages the lip 31, preventing the tooth 24 from falling into the socket portion 19. A cap 33 is placed over the body 12 near the second end 16 thereof to cover the openings 28 and secure the holding structures 20 to the body 12. As best shown in FIGS. 2-4, preferably three openings 28, spaced about 120° apart with regard to the socket portion 19, and three holding structures 20 are provided.

The spring member 26 provides the associated tooth 24 with resilience, allowing the tooth 24 to compress when the socket 10 engages the fastener. In the embodiment, each spring member 26 is an elastic member such as a rubber pad, or an array of rubber material such as rubber balls. Alternatively, each spring member 26 can be a spring such as a coil, leaf, or other type of small spring applying a spring force to the rigid tooth 24. As best shown FIG. 3, a portion of engaging surface 27 of each tooth 24, closest to the second end 16 of the socket 10, includes a chamfered surface 34 tapering (enlarging) towards the second end 16. The chamfered surface 34 is engaged by the fastener when the fastener is introduced into the socket portion 19, which causes the spring member 26 to compress.

The teeth 24 provide a sufficient friction force on the head of the fastener to securely grasp it and keep it from falling out of the socket portion 19. When three teeth 24 are provided, the teeth 24 also provide sufficient force on the fastener head to keep fastener aligned concentrically with the socket portion 19. This will allow the fastener to rotate concentrically with the socket portion 19 making the fastening process easier. The teeth 24 are strictly intended to retain the fastener and do not exert torque on the fastener for fastening or unfastening purposes when the socket 10 is rotated. The teeth 24 are intentionally located on the flat surfaces 18 of the socket portion 19 rather than on the corners to retain the torque transmission capabilities of the socket portion 19.

Figure 5:
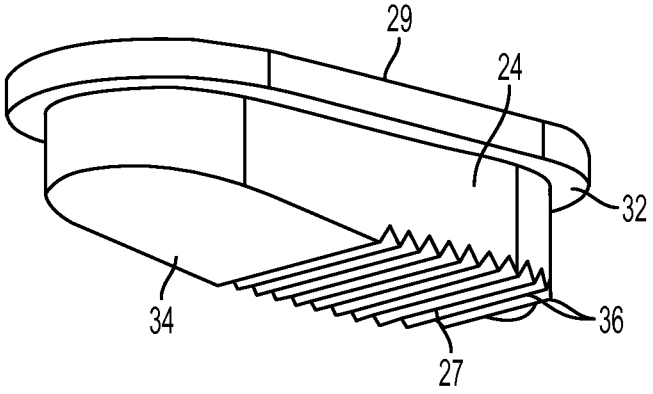
FIG. 5 is an enlarged view of a tooth of the holding structure of FIG. 1.
Figure 6:
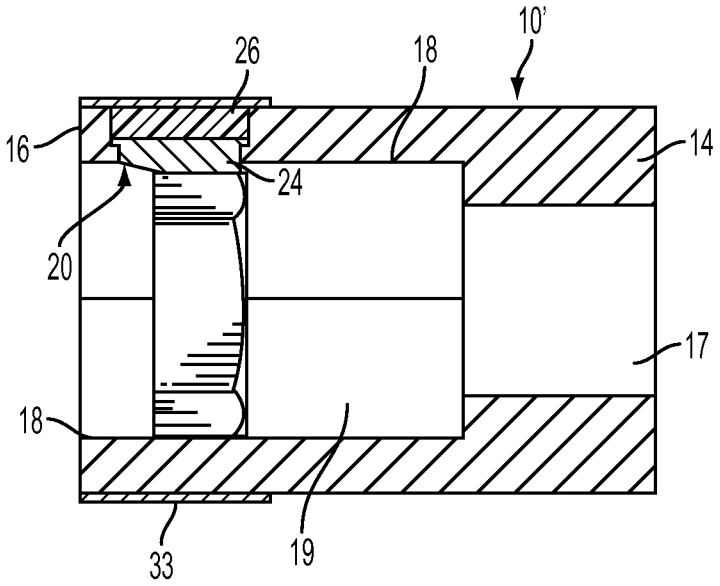
FIG. 6 is sectional view of another embodiment of the socket with a single holding structure holding a nut within a socket portion.

As shown in FIG. 5, to increase the friction gripping force on the fastener, each or some of the teeth 24 can include a surface feature such as knurling or serrations 36 on a the engaging surface 27 thereof.

Returning to FIG. 3, a wrench 42 with an adaptor 40 is received in the tool-receiving portion 17. The wrench adaptor 40 can be operated manually or can be coupled to another tool which provides rotation and torque, such as a pneumatic or electric wrench tool. The wrench tool itself can be operated manually of automatically, such as with an industrial robot or another movable carrier mechanism. In either manual or automated use, the teeth 24 of the holding structure 20 engage and hold the fastener within the socket portion 19 to prevent the fastener from falling out of the socket portion 19 while transporting the fastener to or from the location where it is to be fastened.

Instead of providing the holding structures 20 as in the embodiment of FIGS. 1-4, FIG. 6 shows is a sectional view of a socket 10' having a single holding structure 20 holding a fastener, in the form of a nut 43, in engagement with a surface 18 of the socket portion 19.

Figure 7:
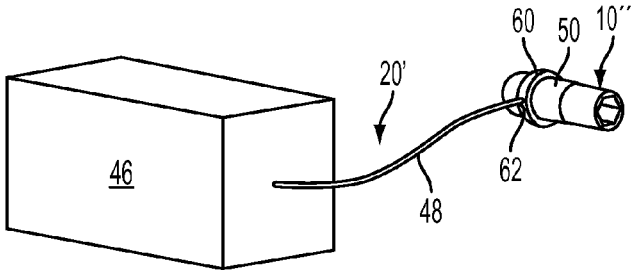
FIG. 7 a view of a socket with holding structure, provided in accordance with another embodiment, with the holding structure including a vacuum system, drive shaft and collar.
Figure 8A:
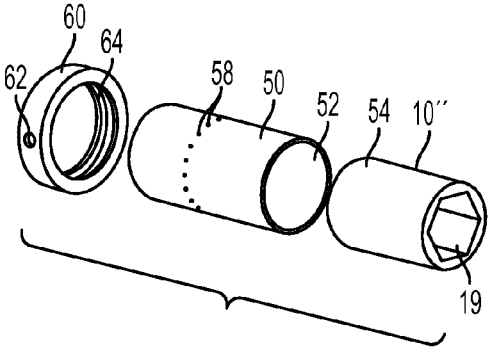
FIG. 8A is a front exploded view of the socket, collar and drive shaft of FIG. 7.
Figure 8B:
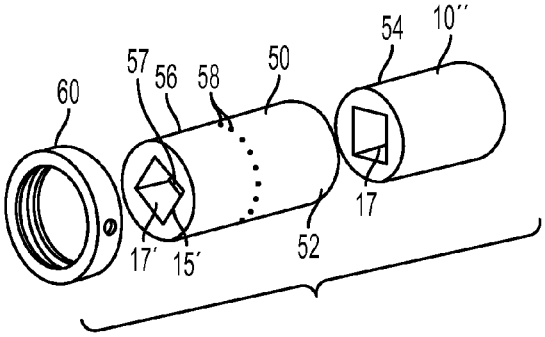
FIG. 8B is a rear exploded view of the socket, collar and drive shaft of FIG. 7.
Figure 9:
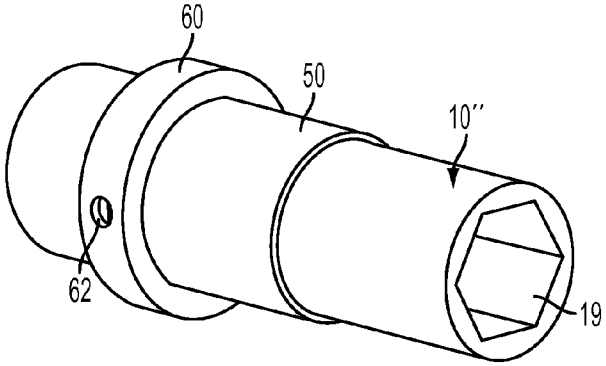
FIG. 9 is a perspective view of the socket, collar and drive shaft of FIG. 7.

FIG. 7 shows another embodiment of a socket, generally indicated at 10". Instead of providing the holding structure in the form of teeth and spring members, the holding structure 20' includes a vacuum source 46 in communication with the socket portion 19 via a tube 48. In the embodiment of FIGS. 7-9, the holding structure 20' also includes a tubular drive shaft 50 having an opened first end 52 for receiving an end 54 of the socket 10", preferably in a press-fit manner. Alternatively, the socket 10" can be welded or adhered to the drive shaft 50. The second end 56 of the drive shaft 50 includes surfaces 15' defining a tool-receiving portion 17' similar to that of the socket 10" for engaging a wrench or the like for driving the socket 10". However, the tool-receiving portion 17' of the drive shaft 50 does not communicate with opened end 52 due to providing an end wall 57. At least one vacuum port 58 is provided through a wall of the drive shaft 50. In the embodiment, a plurality of ports 58 are provided about the circumference of the drive shaft 50 to communicate with the opened end 52 thereof and thus with the tool-receiving portion 17 of the socket 10".

The holding structure 20' further includes a collar 60 disposed about the drive shaft 50 so as to cover the ports 58. The tube 48 is connected with a port 62 through the collar 60 and port 62 communicates with ports 58. A bushing or bearing 64 is provided between the collar 60 and the drive shaft 50 permitting the drive shaft 50 and socket 10" therein to rotate with respect to the stationary collar 60. The bushing or bearing 64 also serves as a seal between the collar 60 and the drive shaft 50. Alternatively, separate seals may be used to seal the gap between the collar 60 and drive shaft 50. A vacuum, provided by the vacuum source 46, draws air through the tool receiving-portion 17 of the socket 10", through ports 58 and 62 and tube 48. Since tool-receiving portion 17 and the socket portion 19 of the socket 10" communicate with each other, due to the vacuum, the portion of a fastener in the socket portion 19 is held within the socket portion 19.

Figure 10A:
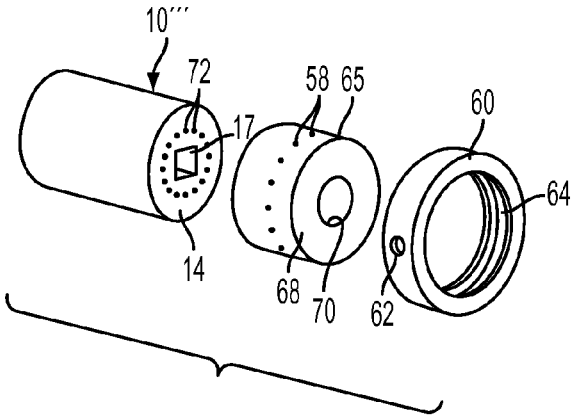
FIG. 10A is a rear exploded view of a socket, collar and cap of yet another embodiment.
Figure 10B:
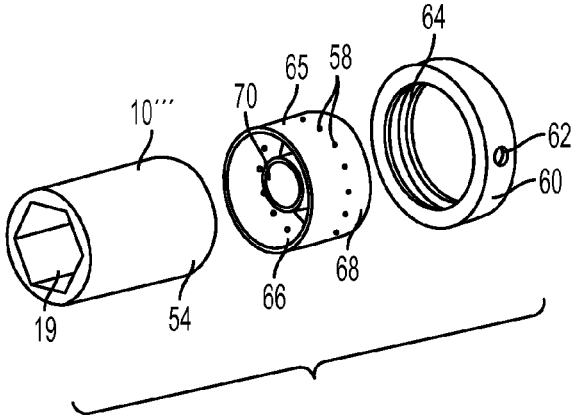
FIG. 10B is a front exploded view of the socket, collar and cap of FIG. 10A.
Figure 11:
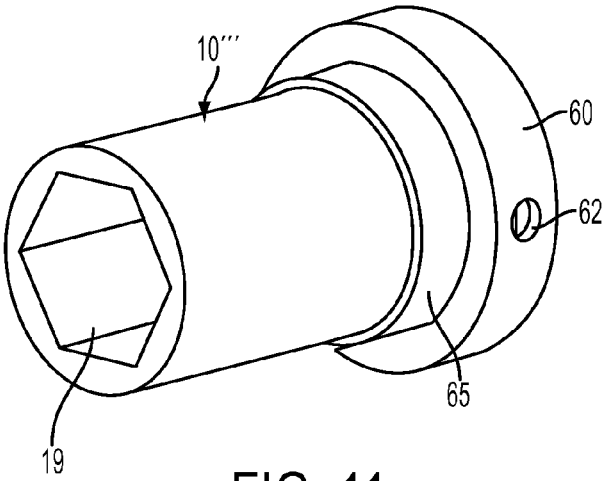
FIG. 11 is a perspective view of the socket, collar and cap of FIG. 10B.

FIGS. 10A, 10B and 11 show yet another embodiment of a socket 10'". Instead of providing the drive shaft 50, the holding structure includes a tubular cap 65 having an opened first end 66 for receiving the end 54 of the socket 10'", preferably in a press-fit manner. A second end 68 of the cap 65 includes an opening 70 for accessing the square tool-receiving portion of the socket 10'". At least one vacuum port 58 is provided through a wall of the cap 65. In the embodiment, a plurality of ports 58 are provided about the circumference of the cap 65 to communicate with ports 72 in end of the socket 10'". The ports 72 communicate with the socket portion 19. The holding structure further includes the collar 60 disposed about the cap 65 so as to cover the ports 58. The tube 48 is connected with the port 62 through the collar 60 and port 62 communicates with ports 58. A bushing or bearing 64 is provided between the collar 60 and the cap 65 permitting the cap 65 and socket 10'" therein to rotate with respect to the stationary collar 60. A vacuum, provided by the vacuum source 46 (FIG. 7), draws air through the socket portion 19, through ports 72, 58 and 62 and tube 48. Due to the vacuum, the portion of a fastener in the socket portion 19 is draw against the inner face 18' (FIG. 3) and held.

The cap 65 and drive shaft 50 can be considered to be vacuum port structure. The vacuum can be reversed to blow air through the socket 10 to remove debris.

Thus, disclosed embodiments non-magnetically hold a portion of a fastener to keep it from falling out of the socket portion 19 since friction or vacuum is employed. Since no magnetic forces are required, the embodiments eliminate the possibility of foreign, ferrous material being attracted to the socket and enter the socket portion 19. Another advantage of the socket is that an outside diameter thereof is similar to that of conventional sockets. Thus, the socket can engage fasteners that are close to obstructions or close to neighboring fasteners.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A socket for removing or installing a fastener having a hexagonal shaped portion, the socket comprising:

a body having a longitudinal axis and opposing first and second ends, first surfaces defining a tool-receiving portion at the first end, the tool-receiving portion being constructed and arranged to receive a portion of a tool, second surfaces defining a socket portion at the second end, the socket portion being constructed and arranged to receive and engage the portion of the fastener therein, holding structure associated with the socket portion and constructed and arranged to non-magnetically hold the portion of the fastener in the socket portion so as to not fall out of the socket portion, without providing torque to the fastener when the socket is rotated during installation or removal of the fastener, and a cap over a portion of the body near the second end thereof to cover the opening and secure the holding structure to the body, wherein the body includes a wall having at least one opening there-through so as to communicate with the socket portion, and wherein the holding structure is associated with the opening and comprises:

a tooth having a chamfered surface constructed and arranged to engage the fastener when the fastener is introduced into the socket portion, the tooth also having a plurality of serration to provide a friction force on the portion of the fastener while in the socket portion, and a spring member engaged with the tooth, the tooth being disposed in the opening so as to extend into the socket portion, wherein when the fastener is disposed in the socket portion, the serration resiliently engage the portion of the fastener.

2. The socket of claim 1, wherein the body includes a plurality of openings there-through with a holding structure being associated with a respective opening, the holding structure being constructed and arranged to keep the fastener aligned concentrically within the socket portion.

3. The socket of claim 1, wherein the tooth is rigid and the spring member is constructed and arranged to apply a spring force to the rigid tooth.

4. The socket of claim 3, wherein the spring member is an elastic member.

5. The socket of claim 4, wherein the elastic member is a rubber pad.

6. The socket of claim 1, in combination with a wrench received in the tool-receiving portion.

7. The socket of claim 1, wherein the at least one opening extends perpendicularly with respect to the longitudinal axis.

8. A socket for removing or installing a fastener having a hexagonal shaped portion, the socket comprising:

a body having a longitudinal axis and opposing first and second ends, first surfaces defining a tool-receiving portion at the first end, the tool-receiving portion being constructed and arranged to receive a portion of a tool, second surfaces defining a socket portion at the second end, the socket portion being constructed and arranged to receive and engage the portion of the fastener therein, and holding structure associated with the socket portion and constructed and arranged to non-magnetically hold the portion of the fastener in the socket portion so as to not fall out of the socket portion, without providing torque to the fastener when the socket is rotated during installation or removal of the fastener, wherein the holding structure includes a vacuum source in communication with the socket portion such that when a vacuum is created, the vacuum holds the portion of the fastener against one of the second surfaces defining the socket portion, wherein the holding structure further comprises:

a drive shaft having an opened first end receiving the first end of the socket, a second end of the drive shaft having surfaces defining a second tool-receiving portion constructed and arranged to receive a portion of a tool, the drive shaft including at least one vacuum port through a wall thereof and communicating with the tool receiving portion and socket portion of the socket, a collar disposed about a portion of the drive shaft, the collar having a port in communication with the at least one vacuum port, structure permitting the drive shaft and socket to rotate with respect to the collar, and a tube connecting the vacuum source to the port in the collar such that when a vacuum is created, the portion of fastener is held in the socket portion.

9. A socket for removing or installing a fastener having a hexagonal shaped portion, the socket comprising:

a body having a longitudinal axis and opposing first and second ends, first surfaces defining a tool-receiving portion at the first end, the tool-receiving portion being constructed and arranged to receive a portion of a tool, second surfaces defining a socket portion at the second end, the socket portion being constructed and arranged to receive and engage the portion of the fastener therein, and holding structure associated with the socket portion and constructed and arranged to non-magnetically hold the portion of the fastener in the socket portion so as to not fall out of the socket portion, without providing torque to the fastener when the socket is rotated during installation or removal of the fastener, wherein the holding structure includes a vacuum source in communication with the socket portion such that when a vacuum is created, the vacuum holds the portion of the fastener against one of the second surfaces defining the socket portion, wherein the holding structure further comprises:

a cap having an opened first end receiving the first end of the socket, a second end of the drive shaft having an opening for accessing the tool-receiving portion of the socket, the cap including at least one vacuum port through a wall thereof, the socket having at least one port in the first end thereof communicating the socket portion with the at least one vacuum port, a collar disposed about a portion of the cap, the collar having a port in communication with the at least one vacuum port, structure permitting the cap and socket to rotate with respect to the collar, and a tube connecting the vacuum source to the port in the collar such that when a vacuum is created, the portion of fastener is held in the socket portion.

* * * * *